US008806901B2

(12) United States Patent
Hirano et al.

(10) Patent No.: US 8,806,901 B2
(45) Date of Patent: Aug. 19, 2014

(54) ROTARY SINKER, KNITTING MACHINE, AND STITCH FORMING METHOD

(71) Applicant: Okamoto Corporation, Nara (JP)

(72) Inventors: Hideo Hirano, Nara (JP); Kousuke Noguchi, Nara (JP)

(73) Assignee: Okamoto Corporation, Nara (JP)

( * ) Notice: Subject to any disclaimer, the term of this patent is extended or adjusted under 35 U.S.C. 154(b) by 0 days.

(21) Appl. No.: 13/859,845

(22) Filed: Apr. 10, 2013

(65) Prior Publication Data

US 2014/0137605 A1 May 22, 2014

(30) Foreign Application Priority Data

Apr. 11, 2012 (JP) ..... 2012-090469

(51) Int. Cl.

| | |
|---|---|
| ***D04B 15/06*** | (2006.01) |
| ***D04B 15/76*** | (2006.01) |
| ***D04B 35/02*** | (2006.01) |
| ***D04B 39/00*** | (2006.01) |

(52) U.S. Cl.

CPC ..... *D04B 15/06* (2013.01); *D04B 15/76* (2013.01); *D04B 35/02* (2013.01); *D04B 39/00* (2013.01)

USPC ..... 66/105

(58) Field of Classification Search

CPC ..... D04B 13/02; D04B 13/00; D04B 9/00; D04B 15/06; D04B 27/04

USPC ..... 66/104–106

See application file for complete search history.

(56) References Cited

U.S. PATENT DOCUMENTS

| | | | | | |
|---|---|---|---|---|---|
| 421,526 | A | * | 2/1890 | Schmitt | 66/1 R |
| 944,968 | A | * | 12/1909 | Mumford | 66/79 |
| 1,117,032 | A | * | 11/1914 | Gormly | 66/79 |
| 1,232,230 | A | * | 7/1917 | Cummings | 66/94 |
| 1,475,045 | A | * | 11/1923 | Bloom | 66/105 |
| 2,442,412 | A | * | 6/1948 | Holmes et al. | 66/14 |
| 3,971,232 | A | | 7/1976 | Darling | |
| 3,982,409 | A | * | 9/1976 | Conroux et al. | 66/1 R |
| 7,870,760 | B2 | | 1/2011 | Hirano et al. | |
| 8,215,131 | B2 | * | 7/2012 | Hirano et al. | 66/1 R |
| 8,434,332 | B2 | * | 5/2013 | Hirano et al. | 66/105 |

(Continued)

FOREIGN PATENT DOCUMENTS

| | | |
|---|---|---|
| EP | 2 436 812 A1 | 4/2012 |
| JP | 3192202 B2 | 7/2001 |

OTHER PUBLICATIONS

Official Communication issued in corresponding European Patent Application No. 13163165.7, mailed on Jul. 3, 2013.

*Primary Examiner* — Danny Worrell

(74) *Attorney, Agent, or Firm* — Keating & Bennett, LLP

(57) ABSTRACT

A rotary sinker enabling stitch formation by a knitting machine using a rotor for forming a stitch, a knitting machine including the rotary sinker, and a stitch forming method are provided. The ring sinkers as rotating bodies are capable of rotating about a rotation axis independently of each other. The rotation times of the ring sinkers are set to be different from each other. Thus, the rotation times are adjusted to be different between the ring sinker that holds an old loop and the ring sinker that holds a new loop. Adjustment of the rotation times prevents application of a large tension to the knitting yarn made of low stretch fiber, and a stitch can be formed even with a knitting yarn made of non-stretch or low-stretch fiber.

9 Claims, 14 Drawing Sheets

(56) References Cited

U.S. PATENT DOCUMENTS

2010/0126228 A1* 5/2010 Hirano et al. ..... 66/8
2012/0079854 A1* 4/2012 Hirano et al. ..... 66/1 R
2012/0079855 A1* 4/2012 Hirano et al. ..... 66/105

* cited by examiner

ROTARY SINKER, KNITTING MACHINE, AND STITCH FORMING METHOD

BACKGROUND OF THE INVENTION

1. Field of the Invention

The present invention relates to a rotary sinker, a knitting machine, and a stitch forming method.

2. Description of the Related Art

In a knitting machine, a sinker is arranged between knitting needles. The sinker is a different component from the knitting needle and has a function of mainly holding a knitting yarn during formation of a stitch. A known conventional sinker is arranged to reciprocate, as described in U.S. Pat. No. 7,870,760. The conventional sinkers are arranged on both sides of a rotor as a stitch forming portion, and operate by reciprocating to hold the knitting yarn caught by the rotor and remove a stitch thus held from the rotor.

Also, Japanese Patent No. 3192202 describes a stitch forming method in a plain stitch knitting machine. In this method, the knitting machine is arranged, when a first stitch-forming needle catches a fed yarn, not to catch the fed yarn by the next stitch-forming needle. In this arrangement, the fed yarn is directly fed to a hook of the stitch-forming needle without being bent after a yarn-feeding portion.

Recently a technique has been demanded for forming a stitch by a knitting yarn made of low stretch fiber such as carbon fiber. According to the technique of U.S. Pat. No. 7,870,760, a new loop can be easily drawn by an old loop. Therefore, this technique is not suitable for knitting the low stretch fiber. The new loop and the old loop are loops formed by the knitting yarn drawn by the rotor when a stitch is formed by the knitting machine. The loop drawn by (caught by) the rotor is the new loop. When the new loop gets away (goes out of) from the rotor, the new loop is changed into the old loop. According to the technique of Japanese Patent No. 3192202, a yarn which can be easily cut, such as soft twist yarn, is considered. However, since this technique is for knitting machines using the stitch-forming needle, it cannot be applied to a knitting machine using a rotor for stitch formation. Accordingly, there is an unmet demand for a technique which can form a stitch even with a knitting yarn made of low stretch fiber in the knitting machine using the rotor for stitch formation.

SUMMARY OF THE INVENTION

Preferred embodiments of the present invention provide a rotary sinker, a knitting machine, and a stitch forming method which form a stitch even with a knitting yarn made of low stretch fiber in a knitting machine using a rotor for stitch formation.

A preferred embodiment of the present invention provides a rotary sinker arranged between a plurality of stitch forming portions of a knitting machine. The rotary sinker includes a rotary portion arranged to be rotatable about a first axial line, and a supporting portion arranged to support the rotary portion in a rotatable manner. The rotary portion includes a plurality of rotating bodies each including a sinker tooth on a periphery thereof. The sinker tooth is arranged to be a convex portion capable of retaining a knitting yarn. The rotating bodies are rotatable about the first axial line independently of each other.

The rotary portion of the rotary sinker includes a plurality of rotating bodies each including a sinker tooth on its periphery as a convex portion capable of catching a knitting yarn. The rotating bodies hold the knitting yarn fed to the stitch forming portions, respectively. Because the rotating bodies are rotatable about the first axial line independently of each other, the rotation times thereof can be appropriately set. Thus, the rotation time of the rotating body that holds an old loop and that of the rotating body that holds a new loop can be adjusted. Due to this adjustment of the rotation times, application of a large tension to the knitting yarn made of low stretch fiber can be prevented. Therefore, it is possible to form a stitch even with the knitting yarn made of low stretch fiber, according to various preferred embodiments of the present invention.

In the rotary sinker described above, the rotating bodies are the same member including the sinker teeth arranged at a predetermined pitch. According to this arrangement, a stitch of a desired size can be formed by appropriately setting the pitches of the respective rotating bodies. Also, it is possible to use the members commonly.

In the rotary sinker described above, each of the rotating bodies is preferably defined by a substantially flat member, and the rotating bodies are stacked on one another in a plate-thickness direction. According to this arrangement, it is possible to realize a more compact rotary sinker by a simpler arrangement.

In the rotary sinker described above, each of the rotating bodies is approximately ring-shaped, and the supporting portion includes a substantially disk-shaped shaft member accommodated in openings of the rotating bodies; and supporting plates arranged to support the shaft member from both sides in a direction parallel or substantially parallel to the first axial line. According to this arrangement, rotation of the rotating bodies is made more stable by the shaft member.

A preferred embodiment of the present invention provides a knitting machine including a stitch forming portion including a rotor capable of rotating about a second axial line and arranged to form a stitch by rotation of the rotor while the rotor catches a knitting yarn; a sinker arranged on a side of the stitch forming portion to hold the knitting yarn fed to the stitch forming portion; and a holder base arranged to hold the stitch forming portion and the sinker. In the knitting machine, the sinker includes a rotary portion capable of rotating about a first axial line and a supporting portion arranged to support the rotary portion in a rotatable manner, the rotating portion includes a plurality of rotating bodies each including a sinker tooth on a periphery thereof. The sinker tooth is a convex portion capable of catching a knitting yarn. The rotating bodies are rotatable about the first axial line independently of each other.

According to this arrangement, the rotary portion of the sinker includes a plurality of rotating bodies, and each rotating body is provided with a sinker tooth as a convex portion capable of catching a knitting yarn on its periphery. The respective rotating bodies hold the knitting yarn fed to the stitch forming portion. In this arrangement, the rotating bodies can rotate about the first axial line independently of one another. Therefore, the rotation times of those rotating bodies can be appropriately set. Thus, the rotation time of the rotating body that holds an old loop and the rotation time of the rotating body that holds a new loop can be adjusted. This adjustment makes it possible to prevent application of a large tension to the knitting yarn made of low stretch fiber. Thus, according to the aforementioned rotary sinker, a stitch can be formed even with the knitting yarn made of low stretch fiber.

In the knitting machine, when one of the rotating bodies holds a new loop, another one of the rotating bodies holds an old loop, and a rotation time of the other one of the rotating bodies is different from that of the one of the rotating bodies. According to this arrangement, when the new loop passes through the inside of the old loop by rotation of the rotator, the rotation time of the other rotating body to allow the old loop to move out of the rotator can be delayed. Thus, it is possible to prevent application of a large tension to the old loop and form a stitch even with the knitting yarn made of low stretch fiber.

In the knitting machine, the holder base is arranged to make the stitch forming portion and the sinker rotate about a third axial line perpendicular or substantially perpendicular to the first axial line and the second axial line. According to this arrangement, it is possible to form a stitch by the knitting yarn made of low stretch fiber even in a so-called circular knitting machine in which the stitch forming portion and the sinker are rotationally moved by the holder base.

In the knitting machine, a rail cam is further provided which is arranged outside the sinker with respect to the third axial line to have a plurality of first guide grooves capable of receiving the sinker teeth of the respective rotating bodies. The rail cam is operable to guide the sinker teeth by the first guide grooves to control rotation of the rotating bodies. In this arrangement, by rotational movement of the sinker by the holder base, the sinker teeth move within the first guide grooves of the rail cam to control rotation of the rotating bodies. Consequently, the rotating bodies can be surely rotated.

In the knitting machine, when one of the rotating bodies holds a new loop, another one of the rotating bodies holds an old loop, and in the rail cam, a start point of an inclined portion of one of the first guide grooves to rotate the other of the rotating bodies is located on a downstream side of a start point of an inclined portion of another one of the first guide grooves to rotate the one of the rotating bodies in a direction of rotation about the third axial plane. According to this arrangement, the rotation times of the rotating bodies can be made different from each other precisely by the rail cam.

In the knitting machine, a rack cam is further provided which is arranged outside the stitch forming portion with respect to the third axial plane to have a second guide groove arranged to receive at least one of the convex portions located on the periphery of the rotor. The rack cam is operable to guide the convex portion by the second guide groove to control rotation of the rotor. According to this arrangement, by rotational movement of the stitch forming portion by the holder base, the convex portion of the stitch forming portion moves within the second guide groove of the rack cam and rotation of the rotor is controlled. Consequently, the rotor of the stitch forming portion can be rotated surely.

Another preferred embodiment of the present invention provides a stitch forming method using a knitting machine including a plurality of stitch forming portions and a sinker arranged between the stitch forming portions, each of the stitch forming portions including a rotor rotatable about a second axial line and being arranged to form a stitch by rotation of the rotor while the rotor catches a knitting yarn, the sinker being arranged on a side of the stitch forming portion to hold the knitting yarn fed to the stitch forming portion. The method includes a step of making a time at which an old loop is held and a time at which a new loop is held different in an operation of the sinker.

According to this stitch forming method, when the new loop passes through the inside of the old loop by rotation of the rotor, a time at which the sinker draws the old loop can be delayed and therefore application of a large tension to the old loop can be prevented. Thus, a stitch can be formed even with the knitting yarn made of low stretch fiber.

The sinker may be rotary sinker including a plurality of rotating bodies each including a sinker tooth on a periphery thereof as a convex portion capable of catching the knitting yarn, and when one of the rotating bodies holds the new loop, another of the rotating bodies may hold the old loop, and a rotation time of the other of the rotating bodies may be made different from a rotation time of the one of the rotating bodies.

According to various preferred embodiments of the present invention, in a knitting machine forming a stitch by using a rotor, it is possible to form a stitch even with a knitting yarn made of low stitch fiber.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
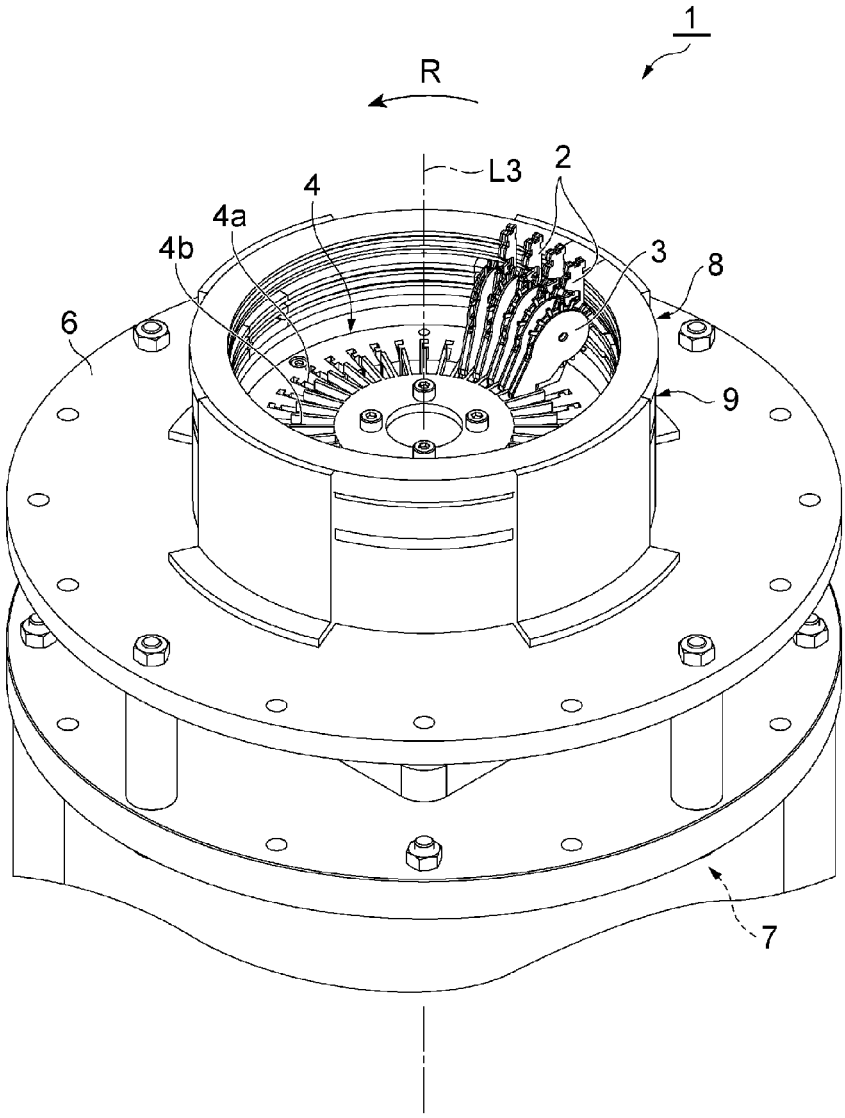
FIG. 1 is a perspective view of a knitting machine according to a preferred embodiment of the present invention.

Hereinafter, preferred embodiments of the present invention are described, referring to FIGS. 1 through 14 in which the same reference signs refer to the same or equivalent elements. Please note that the dimension ratio is not coincident with that in the description. In the description, the term describing the direction such as "upper", "lower" or the like is used for convenience based on the state shown in the drawings.

First, a knitting machine according to a preferred embodiment of the present invention is described. The knitting machine 1 of the present preferred embodiment preferably is a circular knitting machine mainly used for industrial material, as shown in FIG. 1, and is suitable for stitch formation using a knitting yarn made of low stretch fiber such as carbon fiber, for example. The knitting machine 1 includes stitch forming portions 2 operable to form stitches, a rotary sinker 3 operable to hold a knitting yarn fed to the stitch forming portion 2, and a holder base (holder table) 4 operable to hold the stitch forming portion 2 and the rotary sinker 3 and allow the stitch forming portion 2 and the rotary sinker 3 to rotate about a rotation axis (third axial line) L3. The knitting machine 1 also includes a motor 7 operable to drive the holder base 4. The rotation axis L3 extends in a vertical direction. Around the rotation axis L3, the holder base 4 and a base 6 are arranged.

The holder base 4 preferably has a cylindrical or substantially cylindrical shape and includes a stitch-forming-portion groove 4*a* arranged to hold the stitch forming portion 2 and a sinker groove 4*b* arranged to hold the rotary sinker 3. The stitch-forming-portion grooves 4*a* and the sinker grooves 4*b* are alternately arranged in a circumferential direction around the rotation axis L3. The stitch forming portion 2 is inserted in a corresponding stitch-forming-portion groove 4*a* and is fixed to the holder base 4. The rotary sinker 3 is inserted into a corresponding sinker groove 4*b* and is fixed to the holder base 4.

In the knitting machine 1 of the present preferred embodiment, preferably 40 stitch forming portions 2 and 40 rotary sinkers 3 are arranged alternately in the circumferential direction around the rotation axis L3, for example. Thus, the rotary sinker 3 is arranged on the side of a corresponding stitch forming portion 2. The numbers of the stitch forming portions 2 and the rotary sinkers 3 are not limited and can be appropriately determined in accordance with a stitch to be formed. Please note that only some of the stitch forming portions 2 and the rotary sinkers 3 are shown in FIG. 1 but the other stitch forming portions 2 and the other rotary sinkers 3 are omitted from FIG. 1 for ease of understanding.

The motor 7 is arranged to drive the holder base 4 to rotate. The holder base 4 is driven by the motor 7 in a rotational direction R in FIG. 1. The stitch forming portions 2 and the rotary sinkers 3 are moved around the rotation axis L3 by rotation of the holder base 4.

Moreover, the knitting machine 1 also includes a ring-shaped or substantially ring-shaped rack cam 8 arranged outside the stitch forming portions 2 in a radial direction (i.e., on the opposite side of the stitch forming portions 2 to the rotation axis L3) to control rotation of a rotor 11 of each stitch forming portion 2 and a ring-shaped or substantially ring-shaped rail cam 9 arranged outside the rotary sinkers 3 to control each of ring sinkers 36 and 37 of each rotary sinker 3. The rack cam 8 is arranged to be stacked on the rail cam 9. The rack cam 8 and the rail cam 9 are fixed to the base 6 to surround the holder base 4, the stitch forming portion 2, and the rotary sinker 3.

Figure 2:
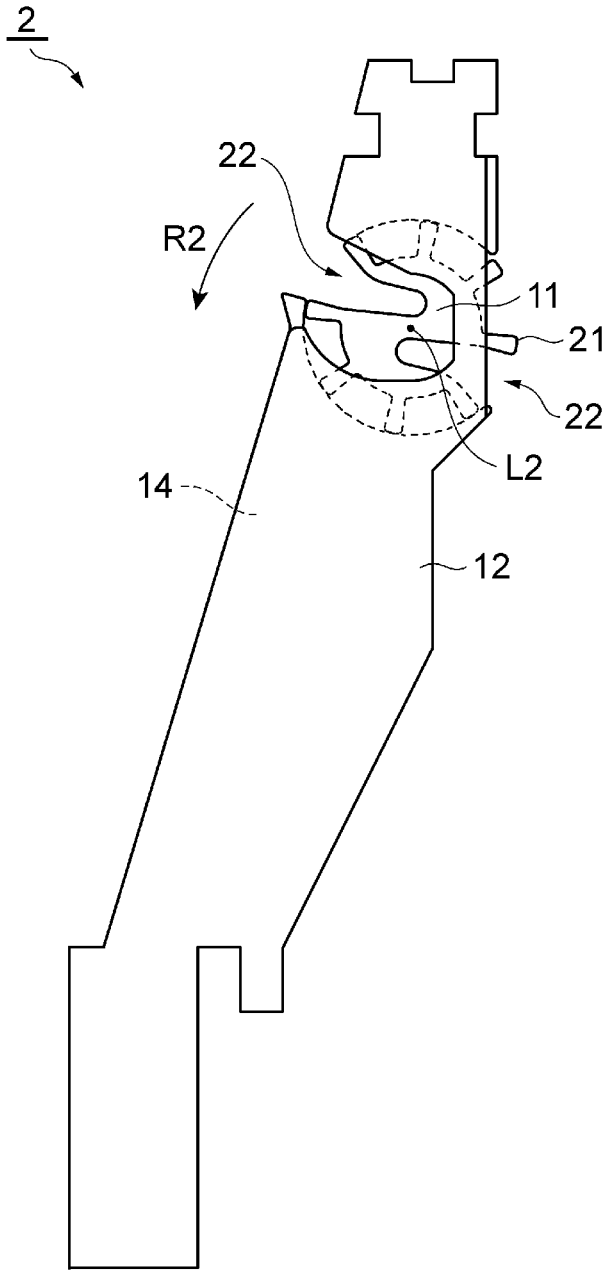
FIG. 2 is a side view of a stitch forming portion in the knitting machine of FIG. 1.
Figure 3:
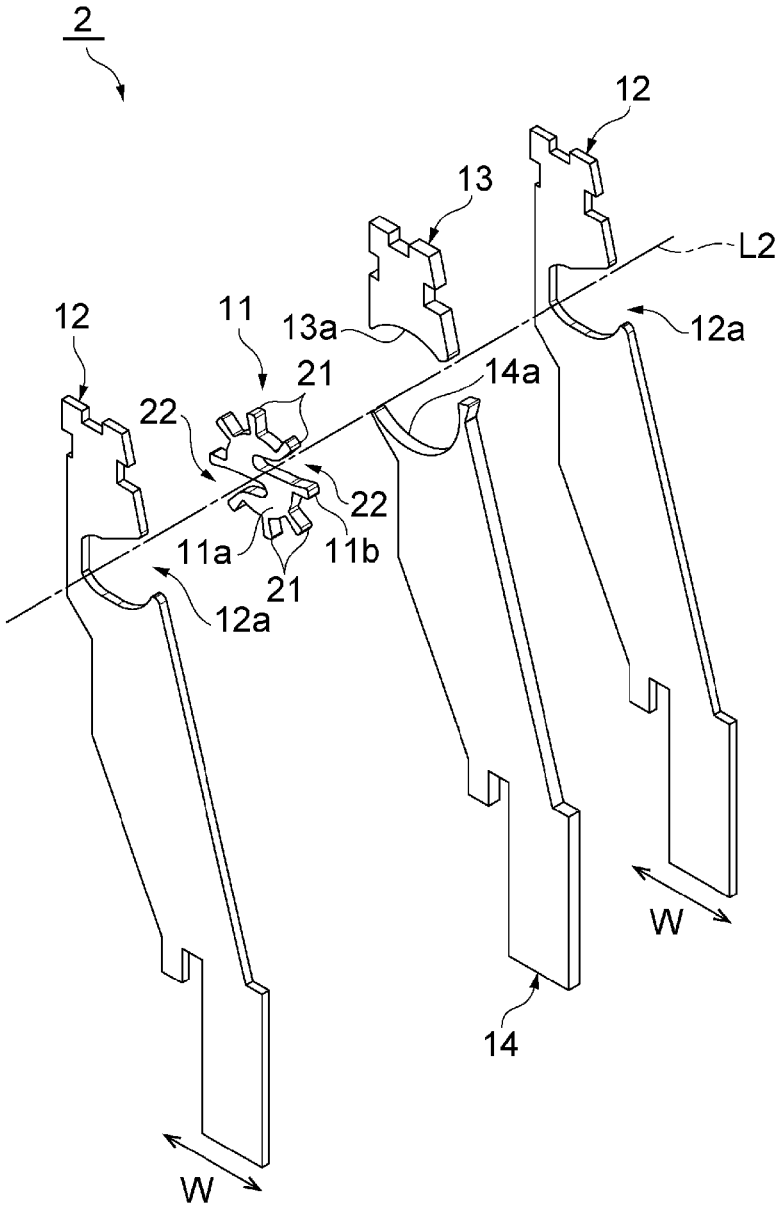
FIG. 3 is an exploded perspective view of the stitch forming portion of FIG. 2.

The stitch forming portion is described referring to FIGS. 2 and 3. FIG. 2 is a side view of the stitch forming portion 2 and FIG. 3 is an exploded perspective view thereof. The stitch forming portion 2 includes a rotor 11, outer plates 12 and 12 and inner plates 13 and 14.

Main surfaces 11*a* opposed to each other in a direction parallel or substantially parallel to the rotation axis (second axial line) L2 of the rotor 11 (hereinafter, referred to as a direction L2) are arranged to be substantially flat. The rotor 11 does not have a projection projecting along the direction L2, so it has a constant or substantially constant thickness. The rotation axis L2 is parallel or substantially parallel to a line connecting predetermined points on two rotary sinkers 3 arranged on both sides of the stitch forming portion 2 to each other. The rotor 11 is arranged around the rotation axis L2, and the inner plates 13 and 14 are arranged above and below the rotor 11, respectively. On both sides of the rotor 11 and the inner plates 13 and 14 in the L2 direction, the outer plates 12 and 12 are arranged.

The rotor 11 is provided with rotor teeth (gear) 21 on its peripheral surface. The rotor teeth 21 are operable to transfer a rotational force to the rotor 11 and are equally spaced from each other on the entire or substantially the entire circumference of the rotor 11. The rotor 11 of the present preferred embodiment preferably has eight teeth, for example. The rotor teeth 21 move within a guide grove (second guide grove) 8*a* of the rack cam 8, so as to be guided by the guide groove 8*a* (see FIG. 6). By being guided by the guide groove 8*a*, the rotor 11 moves around a direction R2 while rotating about the rotation axis L2. Please note that the number of the teeth of the rotor 11 is not limited to eight, although the rotor 11 of the present preferred embodiment preferably includes eight teeth, for example.

The circumferential surface of the rotor 11 (i.e., the top end surface of each rotor tooth 21) serves as a sliding surface. The rotor 11 is supported by the inner plates 13 and 14 described later (see FIG. 3) in a rotatable manner.

The rotor 11 is provided with a pair of hooks (catching concave portions) 22 operable to knit a knitting yarn in. The hook 22 is arranged to be concave from one circumferential-surface side of the rotor 11 toward the center of the rotor 11. In this example, the hook 22 extends to the opposite side of the center to the one circumferential-surface side in the radial direction of the rotor 11. Also, the hook 22 extends through from one of the main surfaces 11*a* of the rotor 11 to the other in the thickness direction of the rotor 11. In this example, two hooks 22 preferably are provided at positions on the circumference of the rotor 11 opposed to each other. However, the number of the hooks 22 is not limited to two. More than two (three or four, for example) hooks 22 can be provided.

The outer plates 12 and 12 preferably are plate-shaped members and are arranged to hold the rotor 11 by sandwiching it from both sides thereof in the L2 direction. Each outer plate 12 is arranged so that its longitudinal direction is coincident or substantially coincident with the vertical direction in the drawings.

The inner plates 13 and 14 preferably are plate-shaped members and are arranged to hold the rotor 11 from both sides in the vertical direction in FIG. 3. The inner plates 13 and 14 are spaced away from each other with the rotor 11 arranged therebetween in the vertical direction in FIG. 3. The inner plates 13 and 14 are sandwiched and supported by the outer plates 12 and 12 from both sides thereof in the L2 direction.

In the stitch forming portion 2, the outer plates 12, the inner plates 13 and 14 and the outer plate 12 are stacked in the plate-thickness direction and fixed to each other. The inner plate 13 is joined to the adjacent outer plates 12 and 12 by welding or other suitable method, for example. The inner plate 14 is also joined to the adjacent outer plates 12 and 12 by welding or other suitable method, for example.

The lower end surface 13*a* of the inner plate 13 is arranged to face the circumferential surface 11*b* of the rotor 11 and serve as a sliding surface to support the rotor 11 in a rotatable manner. The upper end surface 14*a* of the inner plate 14 is also arranged to face the circumferential surface 11*b* and serve as another sliding surface to support the rotor 11 in a rotatable manner.

The outer plate 12 is provided with an opening 12*a* extending therethrough in the plate-thickness direction. The opening 12*a* is arranged to extend from one end of the outer plate 12 in the width direction W of the outer plate 12 toward the other end, but is not open at the other end, as shown in FIG. 3. The outer plate 12 is arranged to be continuous in the vertical direction in FIG. 3 on the other end side.

The opening 12*a* has a function of a path that allows a knitting yarn to enter into the hook 22 of the rotor 11 and also has a function of a path that allows the knitting yarn caught in the hook 22 to move outside. Moreover, a portion of the opening 12*a*, close to the other end side of the outer plate 12, serves as a guiding portion for the knitting yarn caught in the hook 22.

While being attached to the stitch forming portion 2, the rotor 11 is exposed to the outside of the outer plate 12 in the width direction W. More specifically, the rotor teeth 21 of the rotor 11 are exposed to the outside.

Figure 4:
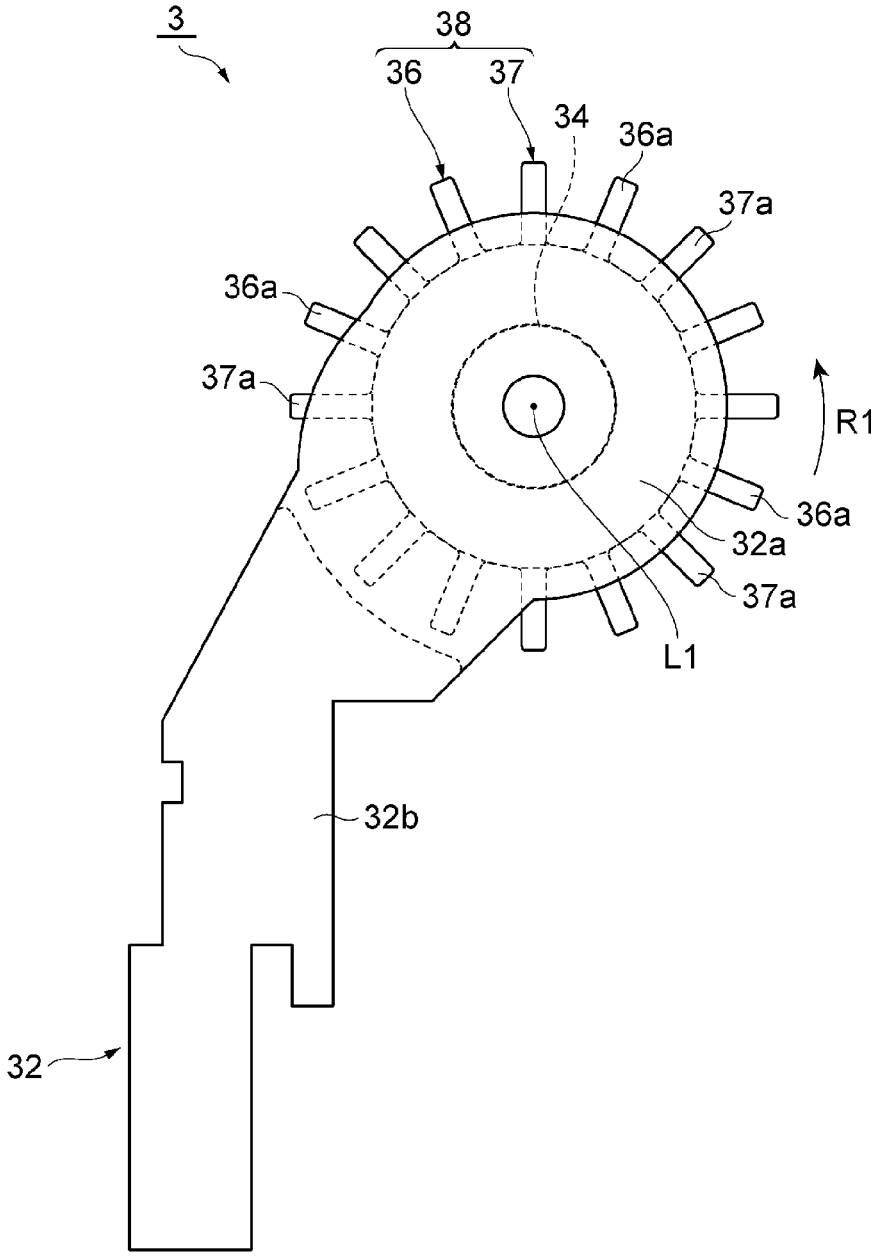
FIG. 4 is a side view of a rotary sinker in the knitting machine of FIG. 1.
Figure 5:
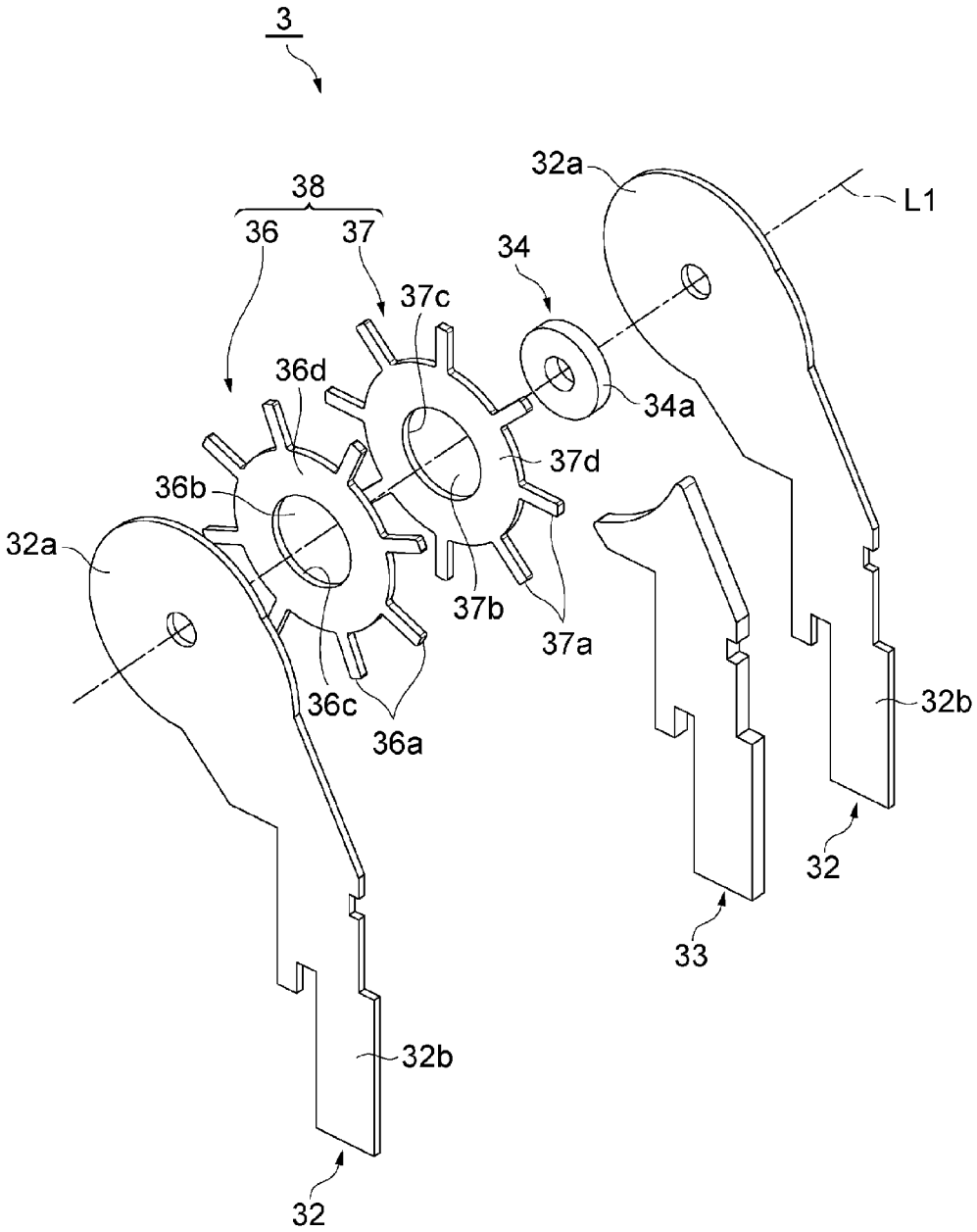
FIG. 5 is an exploded perspective view of the rotary sinker of FIG. 4.

Next, the rotary sinker 3 is described referring to FIGS. 4 and 5. FIG. 4 is a side view of the rotary sinker 3 and FIG. 5 is an exploded perspective view thereof. In the description of the rotary sinker 3, the surface of the rotary sinker 3 which faces to the center of the knitting machine 1 when the rotary sinker 3 is mounted into the knitting machine 1 is assumed to be aback surface, and the surface of the rotary sinker 3 which faces to the outside of the knitting machine 1 is assumed to be a front surface of the rotary sinker 3.

As shown in FIGS. 4 and 5, the rotary sinker 3 includes a rotary portion 38 arranged to be rotatable around a rotation axis (first axial line) L1, outer plates (support plates) 32 and 32, an inner plate 33, and a sinker shaft member 34. The rotation axis L1 is parallel or substantially parallel to a line connecting predetermined points on the stitch forming portions 2 and 2 arranged on both sides of the rotary sinker 3 to each other, and is located diagonally below the rotors 11 and 11. The sinker shaft member 34 is arranged around the rotation axis L1, and the rotary portion 38 is arranged around the sinker shaft member 34. Below the rotary portion 38, the inner plate 33 is arranged. On both sides of the sinker shaft member 34, the rotary portion 38, and the inner plate 33 in a direction parallel or substantially parallel to the rotation axis L1 (hereinafter, simply referred to as a direction L1), the outer plates 32 and 32 are arranged.

In the present preferred embodiment, the rotary portion 38 of the rotary sinker 3 includes a plurality of ring sinkers (rotating bodies). More specifically, the rotary portion 38 includes a ring sinker (first rotating body) 36 and a ring sinker (second rotating body) 37. That is, the rotary portion 38 preferably is a two-component sinker, for example. Each of the ring sinkers 36 and 37 is preferably defined by a flat or substantially flat member. The ring sinkers 36 and 37 are stacked in the thickness direction (the direction L1) thereof. Each of the ring sinkers 36 and 37 includes a plurality of sinker teeth 36*a* and 37*a* equally spaced away from each other on the circumference of the ring sinker. The sinker teeth 36*a* and 37*a* are operable to transfer a rotational force to the respective ring sinkers 36 and 37 and are arranged to move within a guide groove (first guide groove) 9*a* of the rail cam 9, so as to be guided by the guide groove 9*a* (see FIG. 6). By being guided by the guide groove 9*a* in that manner, the respective ring sinkers 36 and 37 are moved in the direction R1 while rotating about the rotation axis L1. In this example, eight sinker teeth 36*a* or 37*a* are provided on the ring sinker 36 or 37. Thus, a total of 16 sinker teeth are provided in the rotary portion 38. It should be noted that the number of the sinker teeth 36*a* or 37*a* of each ring sinker is not limited to eight but can be appropriately determined depending on a stitch size level.

The sinker teeth 36*a* and 37*a* of the ring sinkers 36 and 37 serve as catching portions arranged to hold (catch) a sinker loop in addition to the function of transferring the rotational force. A conventional sinker has a function of assisting a stitch formation by reciprocating, but the ring sinkers 36 and 37 of the present preferred embodiment of the present invention are different from the conventional sinker in function, i.e., the ring sinkers 36 and 37 have functions of holding the sinker loop and transferring the rotational force because the ring sinkers 36 and 37 use rotational movement.

The ring sinkers 36 and 37 are preferably defined by the same members. In other words, the ring sinkers 36 and 37 are preferably defined by members having the same shape and size and made of the same material. Thus, the members can be commonly used. The main surfaces 36*d* and 37*d* of the respective ring sinkers 36 and 37 which are opposed to each other in the direction L1 are arranged to be substantially smooth and flat. The respective ring sinkers 36 and 37 have no projection projecting in the direction L1, so they have a constant or substantially constant thickness. The ring sinkers 36 and 37 have smooth surfaces and therefore can come into sliding contact with each other.

The sinker shaft member 34 is preferably made from a flat or substantially flat plate to have a disk shape or approximate disk shape. The sinker shaft member 34 is accommodated in an opening 36*b* of the ring sinker 36 and in an opening 37*b* of the ring sinker 37 and is sandwiched and supported by the outer plates 32 and 32 from both sides in the direction L1. More specifically, the sinker shaft member 34 is sandwiched by circular portions 32*a* of the outer plates 32. The sinker shaft member 34 is arranged to have an outer diameter corresponding to the size of the openings 36*b* and 37*b* of the ring sinkers 36 and 37. The outer peripheral surface 34*a* of the sinker shaft member 34 serve as a sliding surface to come into contact with the inner circumferential surfaces 36*c* and 37*c* of the ring sinkers 36 and 37. The ring sinkers 36 and 37 are supported by the sinker shaft member 34 and the outer plates 32 and 32. Thus, a supporting portion operable to support the ring sinkers 36 and 37 in a rotatable manner includes the disk-shaped sinker shaft member 34 accommodated in the openings 36*b* and 37*b* of the ring sinkers 36 and 37 and the outer plates 32 and 32 operable to support the sinker shaft member 34 from both sides thereof in the direction L1.

The outer plates 32 and 32 are preferably plate-shaped or substantially plate-shaped and are arranged to hold the ring sinkers 36 and 37 by sandwiching them from both sides in the direction L1. The outer plate 32 includes a circular portion 32*a* arranged to cover the ring sinkers 36 and 37 and a fixing portion 32*b* arranged to be continuous with the circular portion 32*a*. As shown in FIG. 4, the sinker teeth 36*a* and 37*a* of the ring sinkers 36 and 37 project to the outside from an outer profile of the circular portion 32*a*. The fixing portion 32*b* of the outer plate 32 is to be inserted into a sinker groove 4*b* (see FIG. 1) provided in the holder base 4.

The inner plate 33 preferably plate-shaped or substantially plate-shaped and preferably has the same or substantially the same thickness as that of the sinker shaft member 34. The inner plate 33 is sandwiched and supported by a pair of outer plates 32 and 32 from both sides thereof in the direction L1. More specifically, the inner plate 33 is sandwiched by the fixing portions 32*b* of the outer plates 32.

In the rotary sinker 3, the outer plate 32, the inner plate 33, the sinker shaft member 34, and the outer plate 32 are stacked in the plate-thickness direction of them and fixed to each other. The inner plate 33 preferably is joined to the fixing portions 32*b* of the adjacent outer plates 32 by welding or other suitable method, for example. The sinker shaft member 34 preferably is joined to the circular portions 32*a* of the adjacent outer plates 32 by welding or other suitable method, for example.

Figure 6:
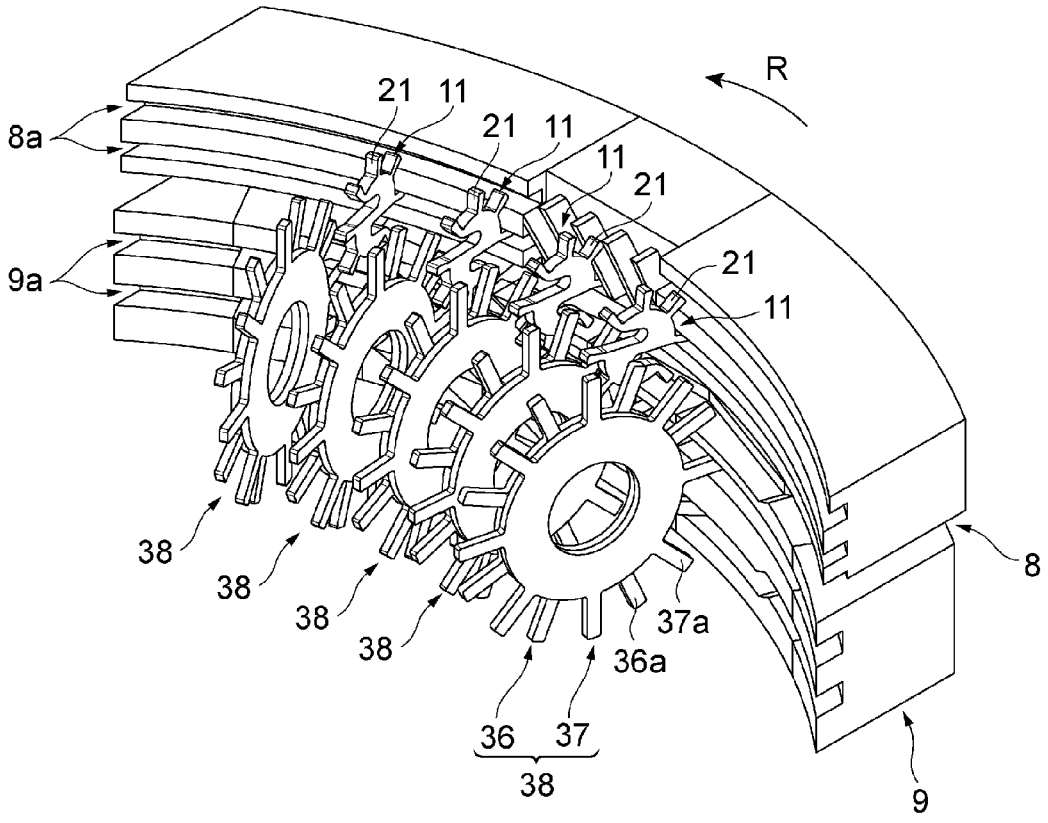
FIG. 6 illustrates the arrangement relationship among a rotor of the stitch forming portion, a ring sinker of the rotary sinker, a rack cam and a rail cam.
Figure 7:
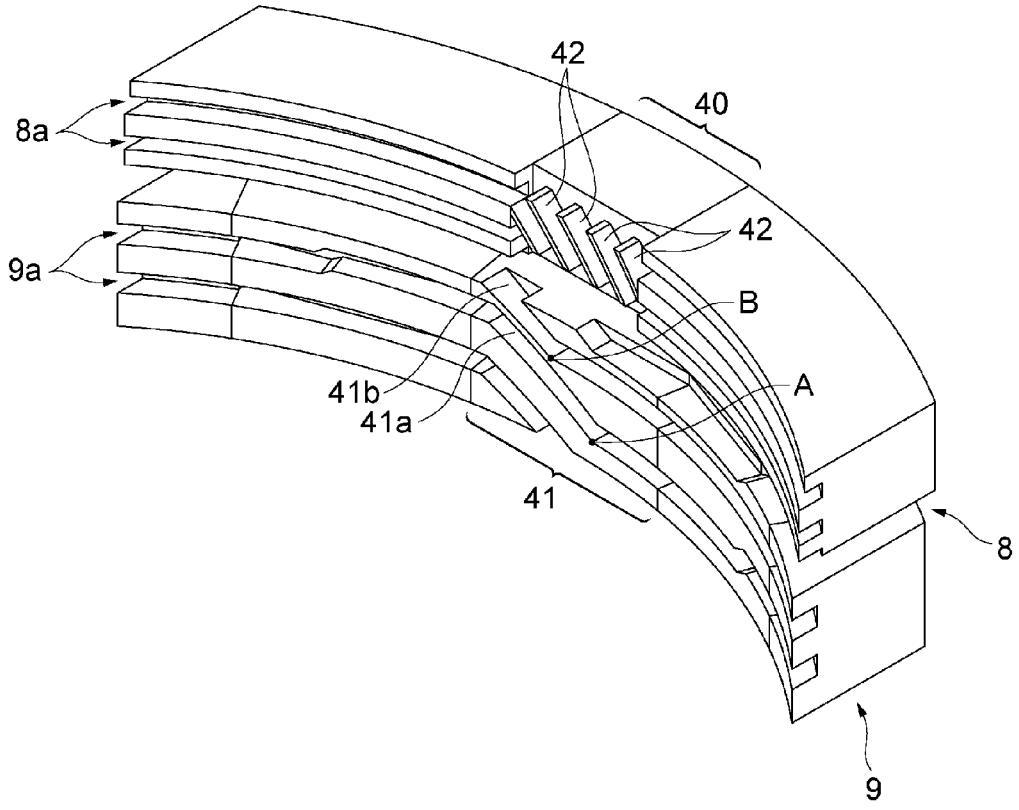
FIG. 7 is a perspective view of the rack cam and the rail cam.
Figure 8B:
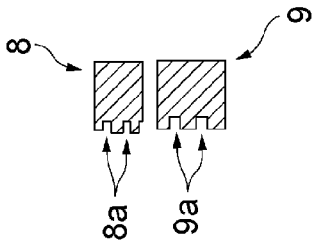
FIG. 8A is a developed view of the rack cam and the rail cam and FIG. 8B is a cross-sectional view of the rack cam and the rail cam.
Figure 8A:
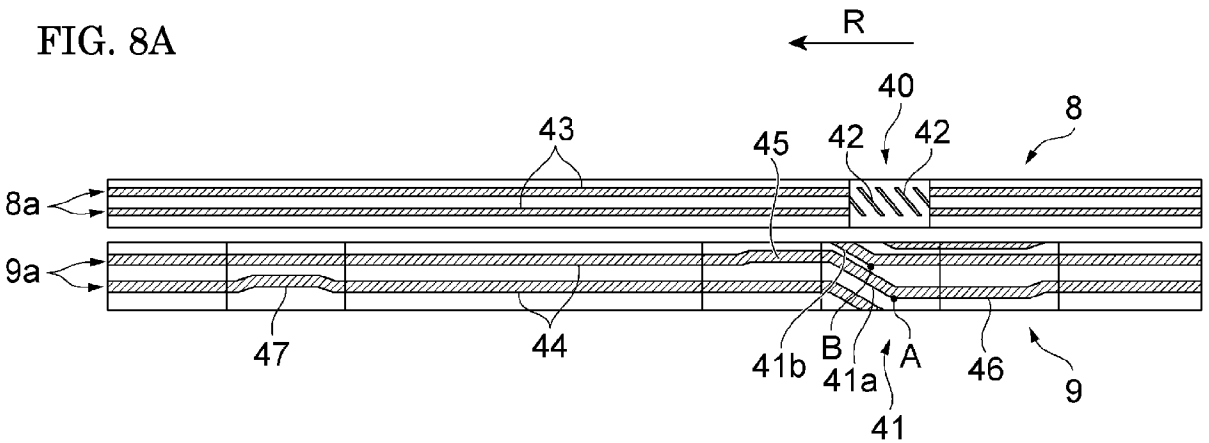

FIG. 6 is a perspective view showing the arrangement of the rotor 11 of the stitch forming portion 2, the ring sinkers 36 and 37 of the rotary sinker 3, the rack cam 8 and the rail cam 9. FIG. 7 is a perspective view of the rack cam 8 and rail cam 9. FIG. 8A is a developed view of the rack cam 8 and rail cam 9, and FIG. 8B is a cross-sectional view of the cams 8 and 9 shown in FIG. 8A. In FIG. 8A, a region in which the guide groove is formed is shown with hatching.

As shown in FIGS. 6 to 8B, the rack cam 8 includes ring-shaped or substantially ring-shaped guide grooves 8*a* and 8*a*. The cross section of each guide groove 8*a*, which is perpendicular or substantially perpendicular to the extending direction of the guide groove 8*a*, preferably is U-shaped or substantially U-shaped and opened toward the inside in the radial direction of the rack cam 8. The rotor teeth 21 of the rotor 11 are accommodated within the guide groove 8*a*. Most of the guide grooves 8*a* include two horizontal portions 43 (see FIG. 8A) extending horizontally parallel or substantially parallel to each other.

A portion of the guide grooves 8*a* at a location in the circumferential direction serves as a rotationally driving portion 40. The rotationally driving portion 40 includes a plurality of racks 42 inclined with respect to a horizontal plane at a predetermined angle. The racks 42 are arranged to guide the rotor teeth 21 of the rotor 11, so as to turn the rotor 11 rotating in the direction R2 (see FIG. 2). More specifically, each rack 42 is arranged to turn the rotor 11 at an angle corresponding to one tooth, so that the racks 42 turn the rotor 11 at an angle corresponding to four teeth. Since the rotor 11 preferably includes eight rotor teeth 21, for example, the rotor 11 is turned by 180 degrees in the direction R2 by passing through the region in which the rotating driving portion 40 is formed.

The rail cam 9 includes ring-shaped or substantially ring-shaped guide grooves 9*a*. The cross section of each guide groove 9*a*, which is perpendicular or substantially perpendicular to the extending direction of that guide groove 9*a*, preferably is U-shaped or substantially U-shaped and opened toward the radially inside. The sinker teeth 36*a* and 37*a* of the ring sinkers 36 and 37 are accommodated in the guide groove 9*a*. Most of the guide grooves 9*a* preferably include two horizontal portions 44 extending horizontally parallel or substantially parallel to each other (see FIG. 8A).

A portion of the guide grooves 9*a* at a location in the circumferential direction serves as a rotationally driving portion 41. The rotationally driving portion 41 includes a sinker-rotation groove (inclined portion) 41*a* arranged to extend at a predetermined angle with respect to the horizontal plane and another sinker-rotation groove (inclined portion) 41*b* arranged to extend parallel or substantially parallel to the sinker-rotation groove 41*a*. The sinker-rotation grooves 41*a* and 41*b* are arranged to guide the sinker teeth 36*a* and 37*a* of the ring sinkers 36 and 37, so as to turn the ring sinkers 36 and 37 in the direction R1 (see FIG. 4). More specifically, the sinker-rotation groove 41*a* turns one of the ring sinkers 36 and 37 (which is one holding a new loop) at a certain angle. The other sinker-rotation groove 41*b* turns the other ring sinker 36 or 37 (which is one holding an old loop) at the certain angle. In this manner, the ring sinkers 36 and 37 are arranged to be rotatable about the rotation axis L1 independently of each other. The angle at which each sinker-rotation groove 41*a* and 41*b* turns the ring sinker 36 or 37 corresponds to one tooth as the rotary portion 38, i.e., is 22.5 degrees (360 degrees/16). This angle is not limited and changes depending on the number of teeth (i.e., pitch) of the rotor corresponding to the respective sinker-rotation groove 41*a*, 41*b*.

The ring sinkers 36 and 37 are turned at different times from each other. More specifically, the starting point B of the sinker-rotation groove 41*b* is located on the downstream side of the starting point A of the sinker-rotation groove 41*a* in the direction R. Due to this arrangement, the time at which the other of the ring sinkers 36 and 37 that hold an old loop is turned (rotated) is behind the time at which one of the ring sinkers 36 and 37 that hold a new loop is turned (rotated). Because of the time difference, the ring sinkers 36 and 37 come into sliding contact with each other temporarily.

The guide groove 9*a* further includes an additional-rotation groove 45 arranged to connect the sinker-rotation groove 41*a* to the upper horizontal portion 44 on the downstream side of the rotationally driving portion 41 in the direction R. The additional-rotation groove 45 is arranged horizontally at a slightly higher level than the upper horizontal portion 44. By movement of either one of the ring sinkers 36 and 37 that hold a new loop within the additional-rotation groove 45, that ring sinker is further turned by an extra angle in the direction R1 after having been turned by the aforementioned certain angle. Then, that ring sinker is turned back in (returned) the opposite direction to the direction R1 by the extra angle after passing through the additional-rotation groove 45.

The guide groove 9*a* includes a sinker-returning groove 46 arranged to connect the lower horizontal portion 44 to the sinker-rotation groove 41*a* on the upstream side of the rotationally driving portion 41 in the direction R. The sinker-returning groove 46 is arranged horizontally at a slightly lower level than the lower horizontal portion 44. By movement of either one of the ring sinkers 36 and 37 (which is going to hold a new loop) within the sinker-returning groove 46, that ring sinker is turned back in the opposite direction to the direction R1 by a small angle. That ring sinker is turned in the rotation R1 by the small angle after passing through the sinker-returning groove 46.

Also, the guide groove 9*a* includes an old-loop drawing groove 47 at a position in the circumferential direction. The old-loop drawing groove 47 is arranged horizontally at a slightly higher level than the horizontal portion 44. By movement of the other of the ring sinkers 36 and 37 that hold an old loop within the old-loop drawing groove 47, that ring sinker is turned at a small angle in the direction R1. Consequently, even in a case where the old loop has not yet moved out of the hook 22 of the rotor 11, it is possible to draw the old loop and let it move out of the hook 22 without fail. That ring sinker is turned back in the opposite direction to the direction R1 by the small angle after passing through the old-loop drawing groove 47. The old-loop drawing groove 47 can be provided at any location in the circumferential direction except for the location of the rotationally driving portion 41.

Figure 9:
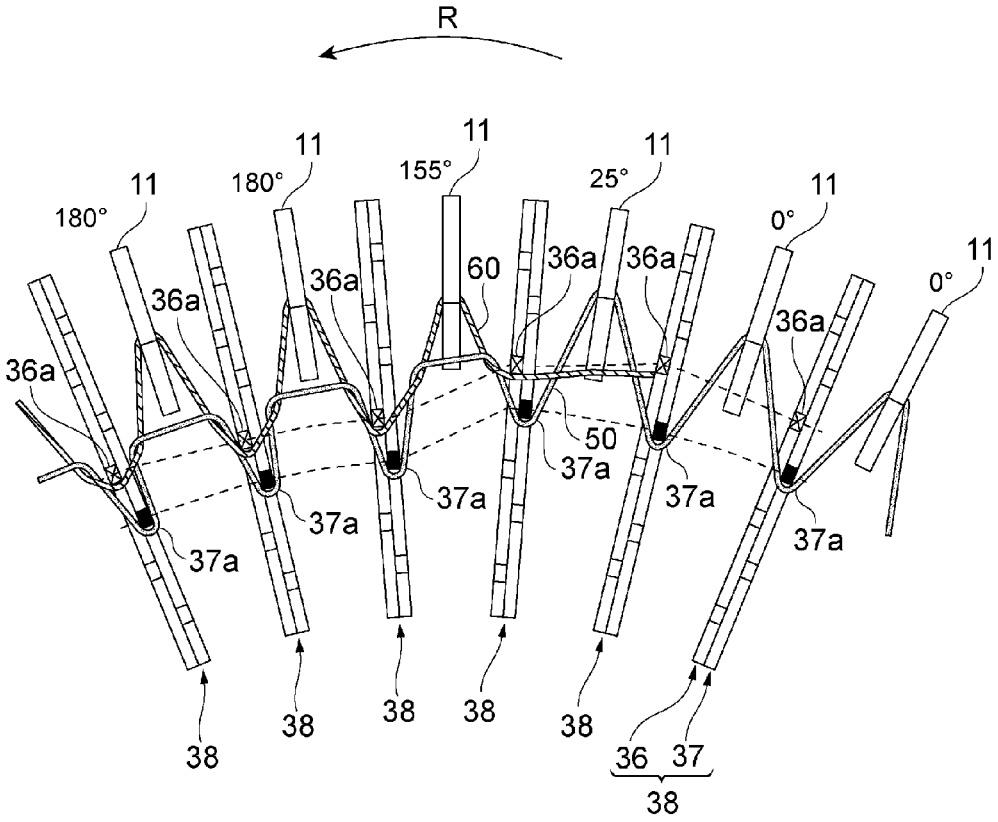
FIG. 9 illustrates a knitting cycle in a case of forming a plain stitch by using the rotor and the sinker.
Figure 10:
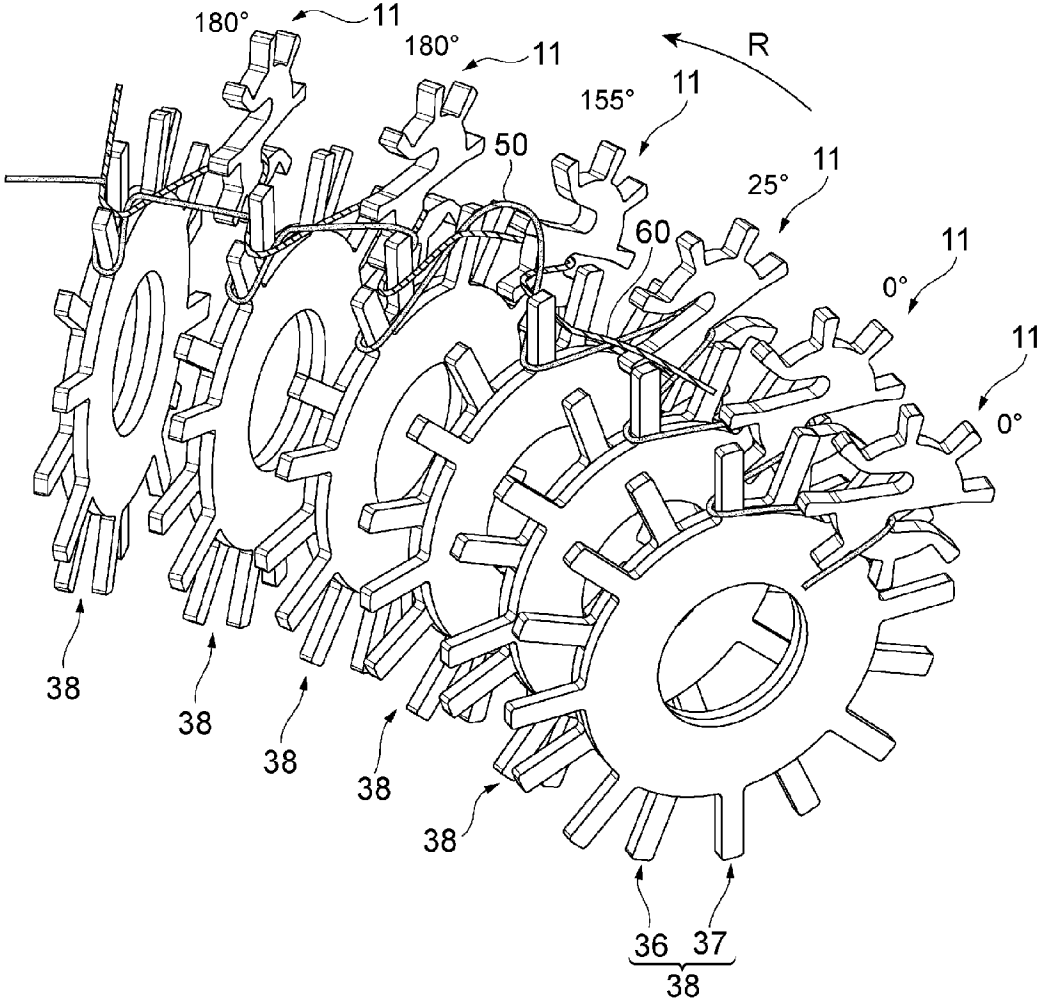
FIG. 10 also illustrates the knitting cycle shown in FIG. 9.

Next, operations and effects of the rotary sinker 3 are described. FIG. 9 is a plan view showing a knitting cycle in case of forming a plain stitch by using the rotor 11 and the ring sinkers 36 and 37, and FIG. 10 is a perspective view showing the same.

Among states shown in FIGS. 9 and 10, a state with "0°" at the most upstream position in the rotation direction R (hereinafter, referred to as the first state) is a state where the rotary portion 38 (the ring sinkers 36 and 37) is located on the upstream side (right side in FIG. 8A) of the sinker-returning groove 46 in the rotational direction R. Another state with "0°" located on the downstream side of the first state (hereinafter, referred to as the second state) in the rotational direction R in FIG. 9 is a state at which the rotary portion 38 is located at the sinker-returning groove 46. A state with "25°" (hereinafter, referred to as the third state) is a state at which the rotor 11 is located at the rotationally driving portion 40 while one of the ring sinkers 36 and 37 is located within the sinker-rotation groove 41*a* and the other within the horizontal portion 44. A state with "155°" (hereinafter, referred to the fourth state) is a state where the rotor 11 is located at the rotationally driving portion 40 and the rotary portion 38 is located at the sinker-rotation grooves 41*a* and 41*b*. A state with "180°" next to the fourth state (hereinafter, referred to as the fifth state) is a state where the rotary portion 38 is located at the additional-rotation groove 45. Another state with "180°" on the downstream side of the fifth state in the rotation direction R (hereinafter, referred to as the sixth state) is a state where the rotary portion 38 is located on the downstream side of the additional-rotation groove 45 in the rotation direction R. Those first to sixth states correspond to states shown in FIGS. 11A, 11B, 12A, 12B, 13A and 13B, respectively.

Figure 11A:
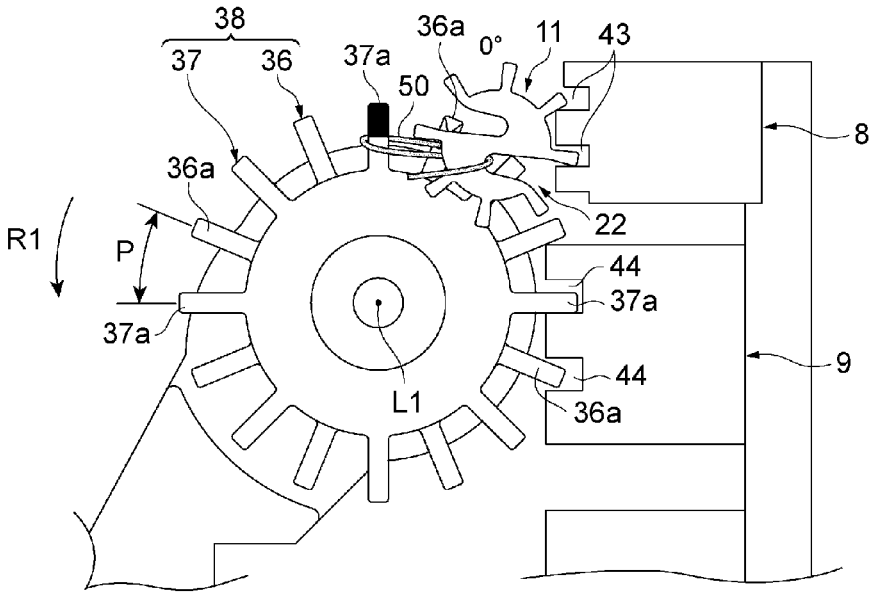
FIGS. 11A and 11B show 0-degree states in FIG. 9, respectively.

As shown in FIG. 11A, in the first state, the distance between each of the sinker teeth 36*a* and the adjacent sinker tooth 37*a* located on the downstream side of that sinker tooth 36*a* in the rotation direction R is kept to be the pitch P. An old loop 50 is caught by one of the hooks 22 of the rotor 11. At the same time the old loop 50 is caught by one of the sinker teeth 37*a* (shown with black in FIG. 11A) of the ring sinker 37. In the following description, the ring sinker 37 corresponds to a rotating body arranged to catch (hold) the old loop 50, while the ring sinker 36 corresponds to a rotating body arranged to catch (hold) a new loop 60.

Figure 11B:
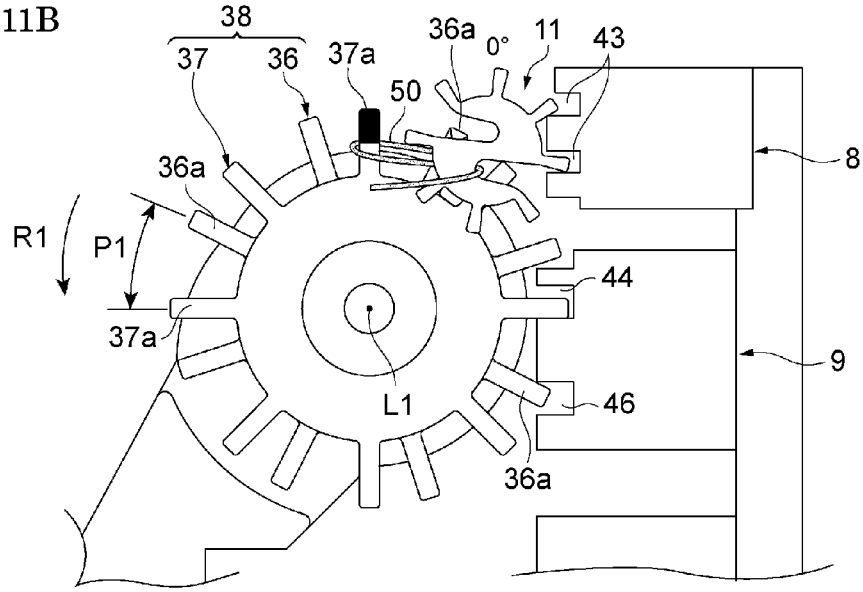

As shown in FIG. 11B, in the second state, the sinker tooth 36*a* of the ring sinker 36 in the rail cam 9 has entered into the sinker-returning groove 46 and therefore the ring sinker 36 has been turned (returned) in the opposite direction to the rotation direction R1 by a small angle. Thus, the space between each sinker tooth 36*a* and the adjacent sinker tooth 37*a* on the downstream side has become the pitch P1 that is slightly larger than the pitch P. In this manner, the aforementioned return of the sinker teeth 36*a* by a small amount makes a new loop 60 to be easily caught by the other hook 22 of the rotor 11 in the next step.

Figure 12A:
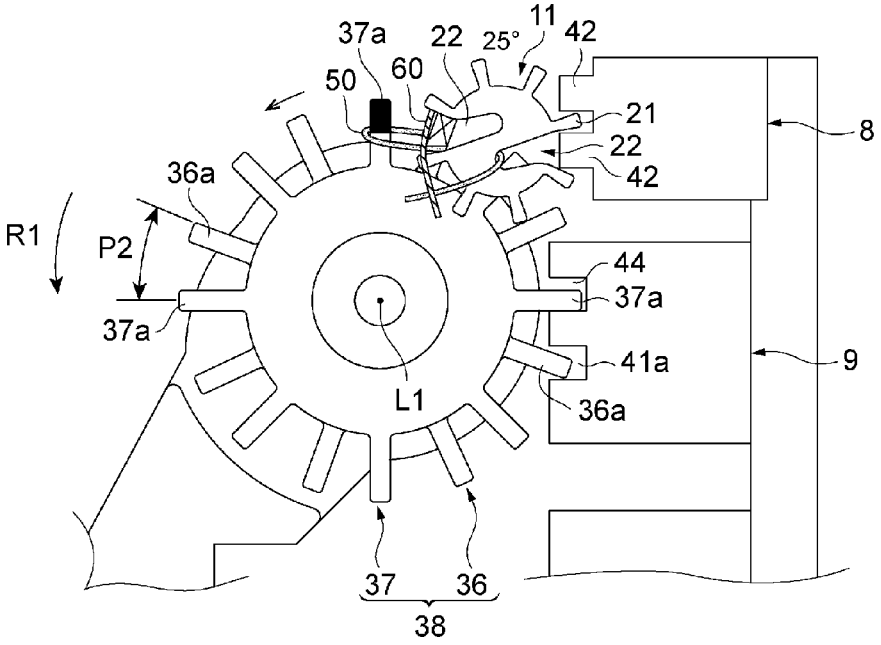
FIGS. 12A and 12B show a 25-degree state and a 155-degree state in FIG. 9, respectively.

As shown in FIG. 12A, in the third state, a rotor tooth 21 of the rotor 11 in the rack cam 8 is in contact with the rack 42 and the rotor 11 has begun rotating (the rotor 11 has been turned by 25 degrees). A sinker tooth 36*a* of the ring sinker 36 in the rail cam 9 has entered into the sinker-rotation groove 41*a* and therefore the ring sinker 36 has begun rotating in the rotation direction R1. On the other hand, the sinker tooth 37*a* of the ring sinker 37 in the rail cam 9 is still located in the horizontal portion 44 and the ring sinker 37 has not begun rotating yet. Thus, the space between that sinker tooth 36*a* and the adjacent sinker tooth 37*a* on the downstream side is a pitch P2 that is smaller than the pitch P. In this state, a new loop 60 is located at the entrance of the other hook 22 of the rotor 11. An old loop 50 is caught by one hook 22, but is not subjected to any extra tension because the rotation of the ring sinker 37 has not started.

Figure 12B:
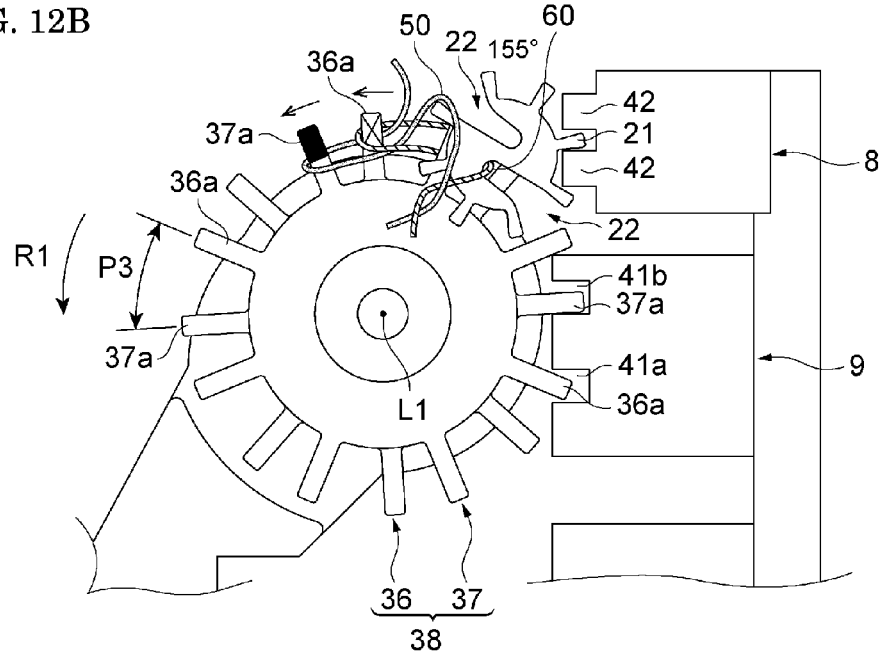

As shown in FIG. 12B, in the fourth state, the rotor tooth 21 of the rotor 11 in the rack cam 8 is in contact with the rack 42 and the rotor 11 is rotating. (In the fourth state, the rotor 11 has rotated by 155 degrees.) The sinker tooth 36*a* of the ring sinker 36 in the rail cam 9 is located in the sinker-rotation groove 41*a* and therefore the ring sinker 36 is rotating in the rotation direction R1. Also, the sinker tooth 37*a* of the ring sinker 37 in the rail cam 9 has entered into the sinker-rotation groove 41*b* and therefore the ring sinker 37 has begun rotating in the direction R1. Due to the difference in start time of rotation between the ring sinkers 36 and 37, the space between each sinker tooth 36*a* and the adjacent sinker tooth 37*a* on the downstream side in the rotation direction R1 in this state is a pitch P3 that is smaller than the pitches P and P2. In this state, holding the old loop 50 by the sinker tooth 37*a* (shown with black) and rotation of the rotor 11 cooperate with each other, so as to make the old loop 50 move out of the hook 22 of the rotor 11. Simultaneously, the new loop 60 is caught in the other hook 22 of the rotor 11 and passes through the inside of the old loop 50.

Figure 13A:
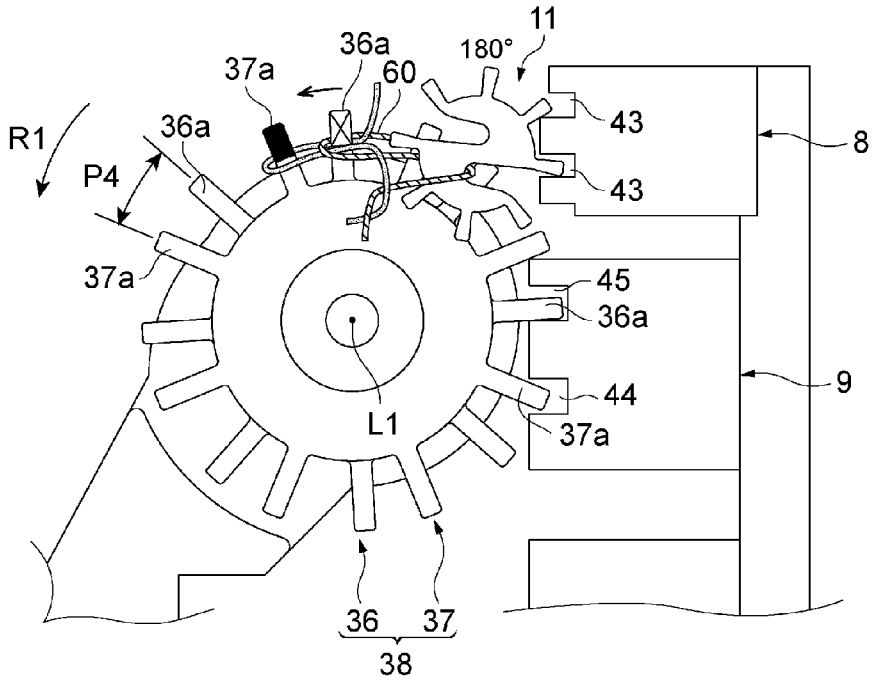
FIGS. 13A and 13B show 180-degree states in FIG. 9, respectively.

As shown in FIG. 13A, in the fifth state, the rotor 11 has passed through the rotationally driving portion 40, the rotor tooth 21 in the rack cam 8 has entered into the horizontal portion 43, and rotation of the rotor 11 has stopped (after the rotor 11 has been turned by 180 degrees). The sinker tooth 36*a* of the ring sinker 36 in the rail cam 9 is in the additional-rotation groove 45 and therefore the ring sinker 36 has been turned in the rotation direction R1 by an extra angle. On the other hand, the sinker tooth 37*a* of the ring sinker 37 in the rail cam 9 is in the horizontal portion 44 and therefore rotation of the ring sinker 37 is stopped. Due to the additional rotation of the ring sinker 36, the space between each sinker tooth 36*a* and the adjacent sinker tooth 37*a* on the downstream side in the rotation direction R1 is a pitch P4 that is smaller than the pitches P and P2. In this state, the new loop 60 is drawn out by one sinker tooth 36*a* (shown with cross-mark in FIG. 13A) and is therefore loosened.

Figure 13B:
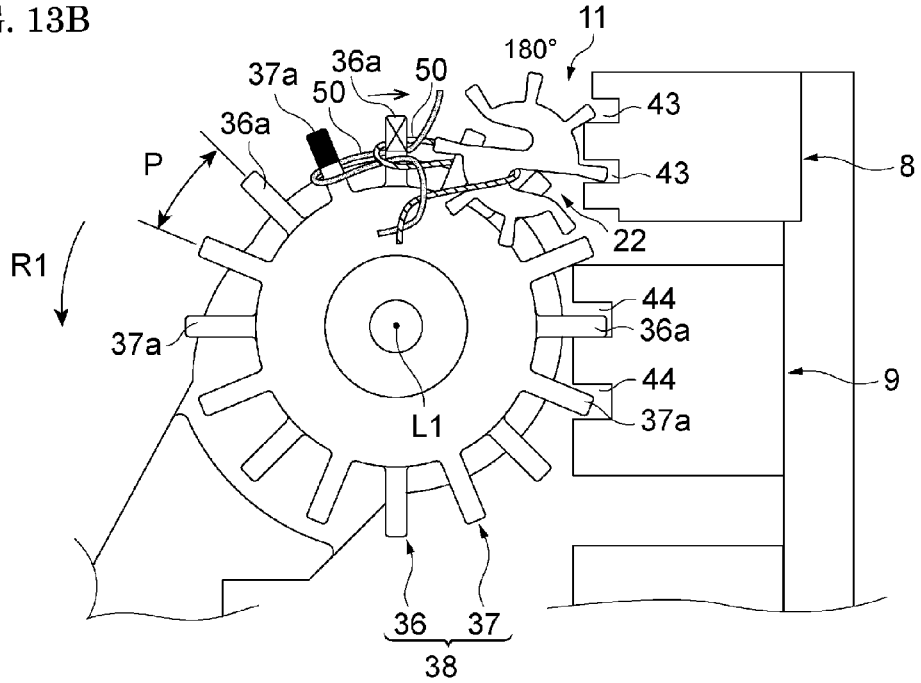
Figure 14:
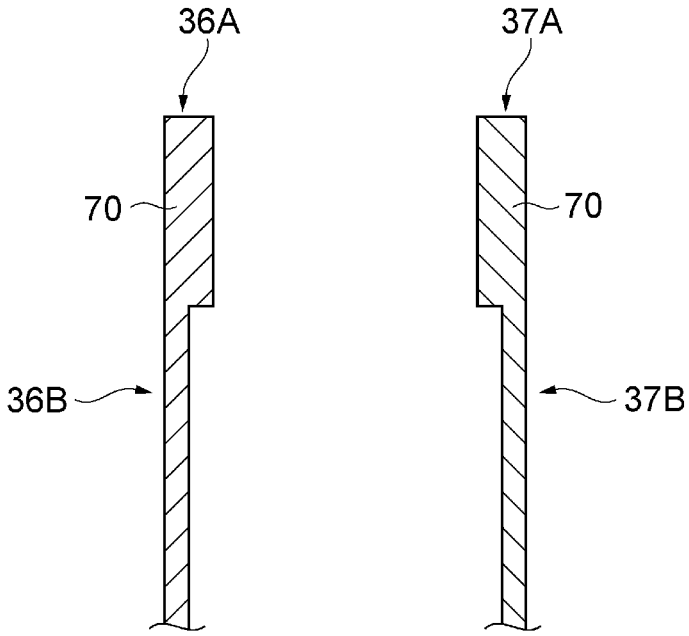
FIG. 14 shows a modification of a sinker tooth of the sinker.

As shown in FIG. 13B, in the sixth state, the sinker tooth 36*a* of the ring sinker 36 in the rail cam 9 has entered into the horizontal portion 44 and the ring sinker 36 has returned by rotating in the opposite direction to the rotation direction R1. In this state, the space between each sinker tooth 36*a* and its adjacent sinker tooth 37*a* is constant, i.e., the pitch P. The new loop 60 held in the hook 22 of the rotor 11 and held by the sinker tooth 36*a* (cross-marked in FIG. 13B) of the ring sinker 36 will become an old loop during formation of a next stitch.

According to the knitting machine 1, the rotary sinker 3, and the stitch forming method of the present preferred embodiment of the present invention, the ring sinker 36 and the ring sinker 37 can be rotatable about the rotation axis L1 independently of each other. Thus, the rotation times such as the rotation start time and the rotation stop time can be appropriately set for each of the ring sinkers 36 and 37. Thus, for each of the ring sinker 37 that holds the old loop 50 and the ring sinker 36 that holds the new loop 60, the rotation start time and the rotation stop time and the magnitude of tension can be adjusted. Due to that adjustment, application of a large tension to a knitting yarn made of low stretch fiber can be prevented. Also, even for a knitting yarn made of low stretch fiber, stitches can be formed. Therefore, it is possible to prevent the knitting yarn from being cut. Moreover, it is possible to prevent application of a burden to the rotor 11 of the stitch forming portion 2. Furthermore, it is possible to prevent stitches from being varied in size or the like and a time period required for stitch formation can be reduced as compared with a conventional knitting machine.

In other words, according to the present preferred embodiment of the present invention, without applying an extra tension to the old loop 50 in a triangle form before the new loop 60 passes therethrough (i.e., in the 25-degree state in FIGS. 9 and 10), the old loop 50 can be changed to the one in a rectangular shape after the new loop 60 has passed therethrough (i.e., in the 180-degree state in FIGS. 9 and 10).

Moreover, the ring sinkers 36 and 37 in the rotary sinker 3 are the same structural members including a plurality of sinker teeth 36*a* and 37*a* arranged at a predetermined pitch. Therefore, it is possible to form a stitch having a desired size by appropriately setting the pitch of each ring sinker 36, 37. Also, the structural members can be used in common.

In the rotary sinker 3, each of the ring sinkers 36 and 36 preferably is defined by a flat or substantially flat plate and stacked in the plate-thickness direction. Therefore, the rotary sinker 3 can be obtained by a simpler and more compact arrangement according to the present preferred embodiment of the present invention.

In the present preferred embodiment of the present invention, each of the ring sinkers 36 and 37 of the rotary sinker 3 preferably is ring-shaped or substantially ring-shaped, and the supporting portion includes a disk-shaped or substantially disk-shaped sinker shaft member 34 which is arranged to be accommodated in the opening 36*b* of the ring sinker 36 and the opening 37*b* of the ring sinker 37, and the outer plates 32, 32 which are arranged to support the sinker shaft member 34 from both sides in the direction L1. Due to this arrangement, the sinker shaft member 34 can make rotation of the ring sinkers 36 and 37 more stable.

In addition, when the new loop 60 passes through the inside of the old loop 50 by rotation of the rotor 11, the rotation start time of the ring sinker 37 that allows the old loop 50 to move out of the rotor 11 is delayed in the present preferred embodiment of the present invention. Thus, application of a large tension to the old loop 50 can be prevented and it is possible to form a stitch even with a knitting yarn made of low stretch fiber (see FIGS. 12A and 12B).

Moreover, the holder base 4 is arranged to allow the stitch forming portion 2 and the rotary sinker 3 to rotate about the rotation axis L3 perpendicular or substantially perpendicular to the rotation axes L1 and L2. Thus, even in a so-called circular knitting machine, a stitch of a knitting yarn made of low stretch fiber can be formed. Consequently, it is possible to form a stitch of a knitting yarn made of low stretch fiber in a flat knitting machine and a warp knitting machine including the circular knitting machine.

Since the knitting machine 1 preferably includes the rail cam 9, when the rotary sinker 3 is caused to rotationally move by the holder base 4, the sinker teeth 36*a* and 37*a* move within the guide grooves 9*a* of the rail cam 9, such that rotation of the ring sinkers 36 and 37 can be controlled. Thus, it is possible to surely rotate the ring sinkers 36 and 37.

Moreover, the start point B of the sinker-rotation groove 41*b* of the guide groove 9*a* is located on the downstream side of the start point A of the sinker-rotation groove 41*a* of the guide groove 9*a* in the rotational direction R. Therefore, the rotation start times can be made different accurately.

The knitting machine 1 in this preferred embodiment of the present invention includes the rack cam 8. Therefore, when the stitch forming portion 2 is caused to rotationally move by the holder base 4, the rotor tooth 21 of the stitch forming portion 2 moves within the guide groove 8*a* and rotation of the rotor 11 is controlled. Thus, it is possible to surely rotate the rotor 11 of the stitch forming portion 2.

According to the stitch forming method of a preferred embodiment of the present invention, when the new loop is passing through the inside of the old loop with rotation of the rotor, it is possible to delay the time at which the rotary sinker 3 draws the old loop 50 and is therefore possible to prevent application of a large tension to the old loop 50. Thus, a stitch can be formed even with a knitting yarn made of low stretch fiber.

Various preferred embodiments of the present invention are described above. However, the present invention is not limited thereto. For example, the ring sinkers 36 and 37 may be replaced with ring sinkers 36A and 37A shown in FIG. 14, each of which includes sinker teeth 36B, 37B each including a thick portion 70 projecting toward the other ring sinker at its top end. The thickness of the thick portion 70 can be set to the thickness obtained when the ring sinkers 36 and 37 are stacked on each other. This arrangement enables the old loop 50 and the new loop 60 to be caught (held) by the sinker teeth 36B and 37B evenly without deviation.

Moreover, a case is described above in which the rotary sinker 3 preferably includes two ring sinkers 36 and 37. However, the rotary sinker may include three or more ring sinkers, for example. In addition, the first rotating body and the second rotating body are not limited to flat plates.

The present invention can be applied not only to a circular knitting machine but also a flat knitting machine. A knitting yarn with which a stitch is formed is not limited to carbon fiber, but may be any non-stretch or low-stretch fiber, e.g., glass fiber.

A case is described above in which the ring sinker (rotating body) of the rotary sinker preferably is rotated by the rail cam, for example. However, the present invention is not limited thereto. The ring sinkers may be driven to rotate by a motor connected to the respective ring sinkers. Furthermore, the present invention is not limited to a case where the rotor (rotating body) of the stitch forming portion is rotated by the rack cam. The rotor may be driven to rotate by a motor connected to the rotor.

The present invention is not limited to a flat knitting machine and a circular knitting machine, but can be also applied to a warp knitting machine.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A rotary sinker arranged between a plurality of stitch forming portions of a knitting machine, comprising:

a rotary portion which rotates about an axial line; and a supporting portion which supports the rotary portion in a rotatable manner; wherein the rotary portion includes a plurality of rotating bodies each including a sinker tooth on a periphery thereof, the sinker tooth is a convex portion capable of retaining a knitting yarn;

the plurality of rotating bodies are not fixed together such that the plurality of rotating bodies rotate about the axial line independently from one another; and each of the plurality of rotating bodies is defined by a substantially flat member, and the rotating bodies are stacked on one another in a thickness direction of the substantially flat members.

2. A rotary sinker according to claim 1, wherein the plurality of rotating bodies and the sinker teeth arranged at a predetermined pitch are integrally provided portions of a same member.

3. A rotary sinker according to claim 1, wherein each of the plurality of rotating bodies is ring-shaped or substantially ring-shaped; and the supporting portion includes:

a disk-shaped or substantially disk-shaped shaft member accommodated in openings of the rotating bodies; and supporting plates arranged to support the shaft member from both sides in a direction parallel or substantially parallel to the axial line.

4. A knitting machine comprising:

a stitch forming portion including a rotor which rotates about a second axial line and arranged to form a stitch by rotation of the rotor while the rotor catches a knitting yarn;

a sinker arranged on a side of the stitch forming portion to hold the knitting yarn fed to the stitch forming portion; and a holder base arranged to hold the stitch forming portion and the sinker; wherein the sinker includes a rotary portion which rotates about a first axial line and a supporting portion which supports the rotary portion in a rotatable manner;

the rotating portion includes a plurality of rotating bodies each including sinker teeth on a periphery thereof, the sinker teeth being convex portions capable of catching the knitting yarn;

the plurality of rotating bodies are not fixed together such that the plurality of rotating bodies rotate about the first axial line independently from one another; and the holder base is arranged to make the stitch forming portion and the sinker rotate about a third axial line that is perpendicular or substantially perpendicular to the first axial line and the second axial line.

5. A knitting machine according to claim 4, wherein, when one of the rotating bodies holds a new loop, another one of the rotating bodies holds an old loop, and a rotation time of the other one of the rotating bodies is different from that of the one of the rotating bodies.

6. A knitting machine according to claim 4, further comprising a rail cam arranged outside the sinker with respect to the third axial line and including a plurality of first guide grooves capable of receiving the sinker teeth of the respective rotating bodies, the rail cam being operable to guide the sinker teeth by the first guide grooves to control rotation of the rotating bodies.

7. A knitting machine according to claim 6, wherein, when one of the rotating bodies holds a new loop, another one of the rotating bodies holds an old loop; and in the rail cam, a start point of an inclined portion of one of the first guide grooves to rotate the other of the rotating bodies is located on a downstream side of a start point of an inclined portion of another one of the first guide grooves to rotate the one of the rotating bodies in a direction of rotation about the third axial line.

8. A knitting machine according to claim 4, further comprising a rack cam arranged outside the stitch forming portion with respect to the third axial line to have a second guide groove arranged to receive at least one of the convex portions located on the periphery of the rotor, the rack cam being operable to guide the convex portion by the second guide groove to control rotation of the rotor.

9. A stitch forming method using a knitting machine including a plurality of stitch forming portions and a sinker arranged between the stitch forming portions, each of the stitch forming portions including a rotor rotatable about a second axial line and being arranged to form a stitch by rotation of the rotor while the rotor catches a knitting yarn, the sinker being arranged on a side of the stitch forming portion to hold the knitting yarn fed to the stitch forming portion, the method comprising:

a step of holding a first loop; and a step of holding a second loop during an operation of the sinker; wherein the sinker is a rotary sinker including a plurality of rotating bodies each including a sinker tooth on a periphery thereof as a convex portion capable of catching the knitting yarn; and when one of the rotating bodies holds the second loop, another of the rotating bodies holds the first loop, and a rotation time of the another of the rotating bodies is different from a rotation time of the one of the rotating bodies.

* * * * *